United States Patent [19]

Knight et al.

[11] Patent Number: 4,592,730

[45] **Date of Patent: * Jun. 3, 1986**

[54] RIFLE TRAINING APPARATUS

[75] Inventors: Lindsay C. Knight, Albury; Brian Compton, Lavington, both of Australia

[73] Assignee: Lomah Electronic Targetry, Inc., Boca Raton, Fla.

[ * ] Notice: The portion of the term of this patent subsequent to Jul. 3, 2001 has been disclaimed.

[21] Appl. No.: 626,921

[22] Filed: Jul. 2, 1984

Related U.S. Application Data

[63] Continuation of Ser. No. 835,431, Sep. 21, 1977, Pat. No. 4,457,715, which is a continuation-in-part of Ser. No. 733,331, Oct. 18, 1976, abandoned, which is a continuation of Ser. No. 617,145, Sep. 26, 1975, abandoned.

[30] Foreign Application Priority Data

Jul. 10, 1975 [AU] Australia ..... 82919/75

[51] Int. Cl.[4] ..... F41F 27/00; F41G 3/26; G09B 19/00

[52] U.S. Cl. ..... 434/22; 273/310; 434/247

[58] Field of Search ..... 434/19, 21, 22; 273/310, 311, 312; 73/379; 340/279; 356/152

[56] References Cited

U.S. PATENT DOCUMENTS

| | | | |
|---|---|---|---|
| 2,268,113 | 12/1941 | Fidelman | 434/19 |
| 2,629,598 | 2/1953 | Hooker | 273/101.1 |
| 2,792,535 | 5/1957 | Marshall et al. | 273/101.1 |
| 2,934,634 | 4/1960 | Hellberg | 273/101.1 |
| 3,083,474 | 4/1963 | Knapp | 273/310 X |
| 3,339,293 | 9/1967 | Kuhlo et al. | 434/22 |
| 3,352,556 | 11/1967 | Chaskin | 273/310 |
| 3,419,732 | 12/1968 | Lane | 273/DIG. 28 X |
| 3,499,650 | 3/1970 | Lemelson | 273/101.1 |
| 3,620,075 | 11/1971 | Edwards | 73/379 |
| 3,644,919 | 2/1972 | Mathauser | 340/279 |
| 3,670,573 | 6/1972 | Kroemer | 73/379 |
| 3,717,857 | 2/1973 | Evans | 273/DIG. 28 X |
| 3,751,828 | 8/1973 | Frame | 343/247 |
| 3,811,204 | 5/1974 | Marshall | 434/22 |
| 3,888,022 | 6/1975 | Pardes et al. | 434/22 X |
| 3,889,396 | 6/1975 | Aronson | 434/20 |
| 3,929,335 | 12/1975 | Malick | 273/DIG. 28 X |
| 3,995,492 | 12/1976 | Clynes | 272/DIG. 5 X |
| 4,065,860 | 1/1978 | Linton et al. | 273/101.1 |
| 4,102,059 | 7/1978 | Kimble et al. | 273/101.1 |
| 4,104,918 | 8/1978 | Alexandru et al. | 73/379 |
| 4,138,118 | 2/1979 | Budney | 273/183 D |
| 4,190,968 | 3/1980 | Clapp et al. | 434/247 |

FOREIGN PATENT DOCUMENTS

| | | |
|---|---|---|
| 477216 | 8/1975 | Australia . |
| 303583 | 11/1972 | Austria . |
| 2308754 | 9/1974 | Fed. Rep. of Germany . |
| 2352433 | 4/1975 | Fed. Rep. of Germany . |
| 4860665 | 11/1971 | Japan . |
| 4913057 | 5/1972 | Japan . |
| 1371361 | 10/1974 | United Kingdom . |
| 445822 | 6/1975 | U.S.S.R. . |

*Primary Examiner*—William H. Grieb

*Attorney, Agent, or Firm*—Schwartz, Jeffery, Schwaab, Mack, Blumenthal & Evans

[57] ABSTRACT

Training apparatus for sporting equipment such as rifles in which at least one transducer which is pressure or weight sensitive is attached to the equipment at a position or positions where the pressure of body weight or contact is critical. The apparatus includes a display having an indicator or indicators connected to the transducer so as to give an indication of the body pressure or weight at the transducer. In one form of the invention, the indicators comprise a series of colored lights associated with each transducer so as to visually indicate insufficient, correct or excessive pressure or weight at the transducer.

51 Claims, 24 Drawing Figures

RIFLE TRAINING APPARATUS

This is a continuation of application Ser. No. 05/835,431, filed Sept. 21, 1977, now U.S. Pat. No. 4,457,715, granted July 3, 1984, which is a continuation-in-part of application Ser. No. 05/733,331, filed Oct. 18, 1976, now abandoned, which was a continuation of application Ser. No. 05/617,145, filed Sept. 26, 1975, now abandoned.

This invention relates to improved training and relates particularly but not exclusively to improved training in relation to sporting equipment where the pressure of body contact with the equipment or the weight of a sportsman on the equipment is important. One embodiment of the invention has particular application in the training of the correct holding of a rifle for marksmanship. Such is particularly suitable for training sportsmen, defense personnel, police personnel and the like.

SUMMARY OF INVENTION

In accordance with one aspect of the present invention there is provided training apparatus for sporting equipment including at least one transducer being pressure sensitive or weight sensitive for attachment to the sporting equipment at positions where the pressure of body contact or body weight is critical, a display for observation by a sportsman, instructor or other person, and an indicator or indicators on the display. The indicator is connectable to the transducer so as to give an indication of the pressure or weight exerted on the transducer. The indicator gives a first indication for one range of pressures or weights and a second indication for another range of pressures or weights, so that the trainee will know when the correct pressure or weight distribution is achieved.

In accordance with a further aspect of the present invention there is provided training apparatus for indicating the accuracy of aim of a rifle or like weapon, including a light beam projector operable for projecting a light beam towards a rifle or like weapon, the rifle or like weapon carrying a reflector. A target at which the rifle or like weapon is to be aimed is provided with a light beam detector for receiving the reflected light beam. A hit display operatively connected with the light beam detector provides an indication when the light beam detector receives a reflection of the projected light beam from the reflector of the rifle or like weapon.

In accordance with a further aspect of the present invention there is provided a light funnel for a target which is to be incided by a beam of light which is representative of the aim of a rifle or like weapon at the target, comprising a plurality of elongate light transmitting members arranged in a group. An end face of each member is positioned and shaped cover a portion of the target area and each elongate member is optically tapered from the target end face to the other end of the member so as to direct substantially all of the light beam received at the target end face to the other end of the member. The face of the non-target end of each member preferably has a cross sectional area substantially the same as a light receiving window face of a respective photo semi-conductor, and such a semi-conductor is mounted for detecting the funnelled light.

It is accordingly an object of the invention to provide apparatus for training of persons in the proper use of devices requiring a predetermined pressure or weight distribution by the user. It is a further object of the invention to provide apparatus for training in the proper holding and aiming of rifles and like weapons. Additional objects and advantages of the invention will be apparent to those skilled in the art from the following drawings and detailed description of the preferred embodiment.

Figure 12:
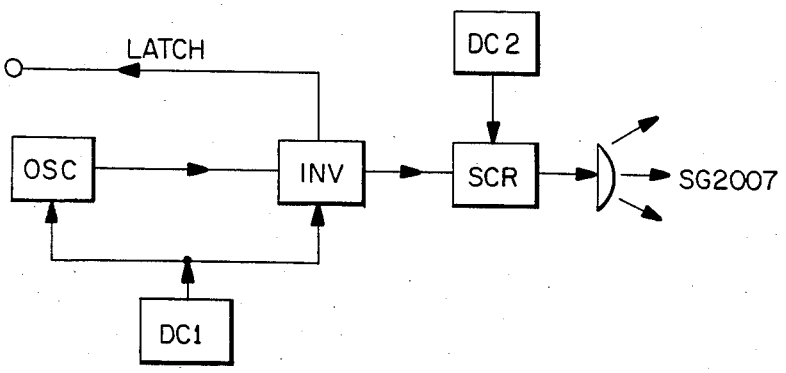
FIG. 12 is a block schematic diagram of the accuracy of aim light transmitter circuitry.
Figure 13:
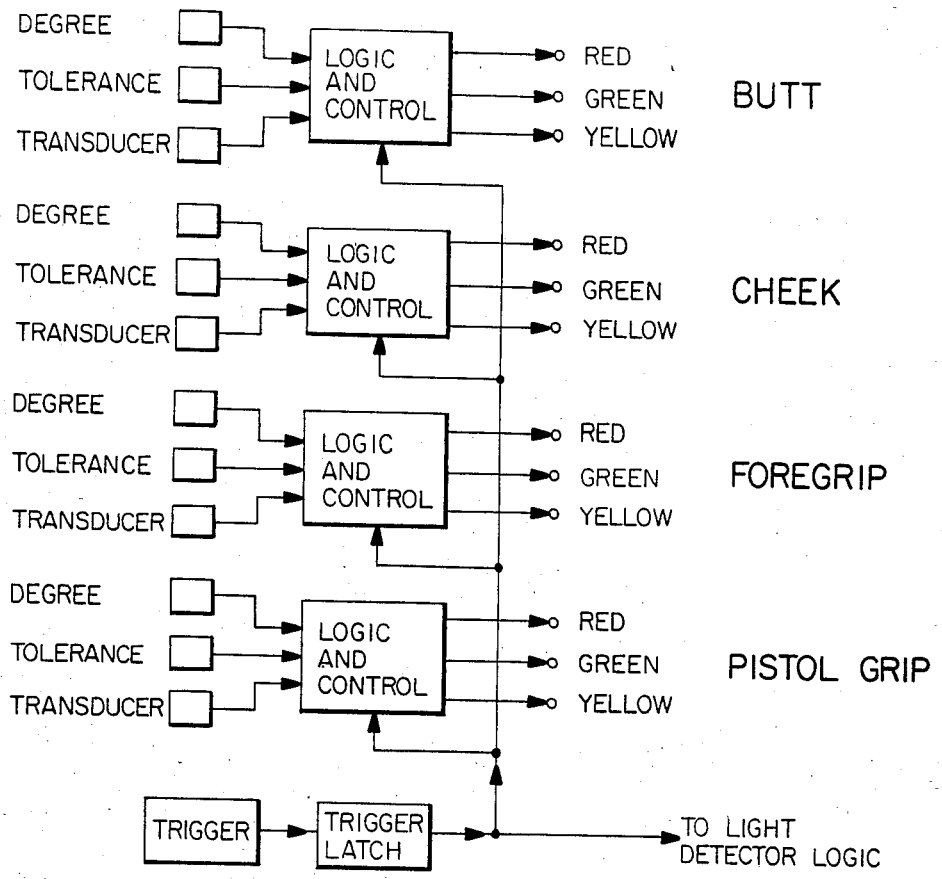
Figure 14:
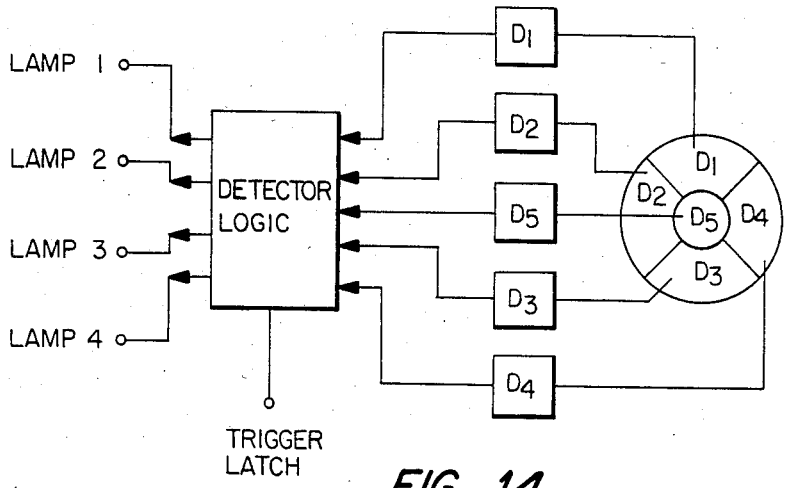
Figure 15:
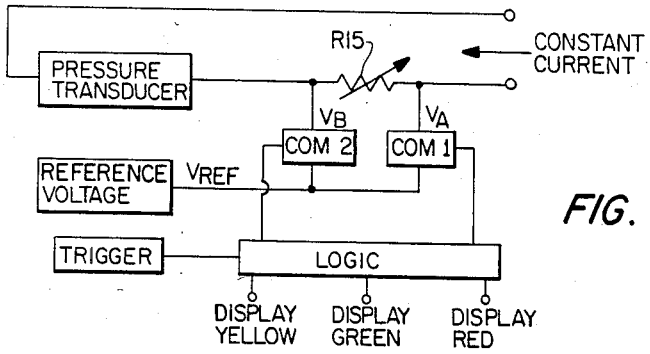
Figure 16:
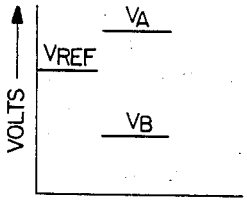
Figure 19:
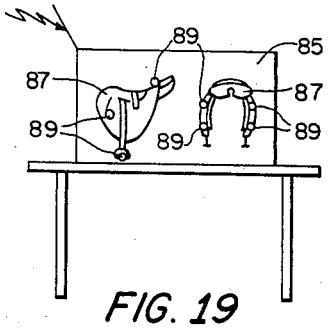
Figure 17:
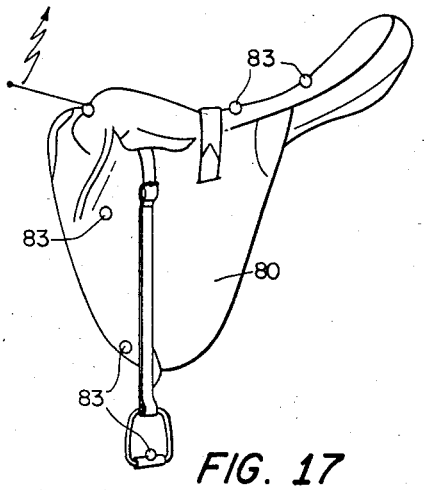
Figure 18:
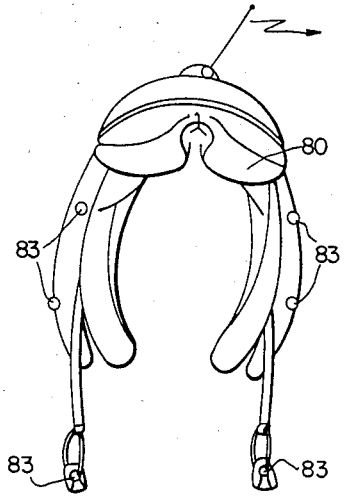
Figure 20:
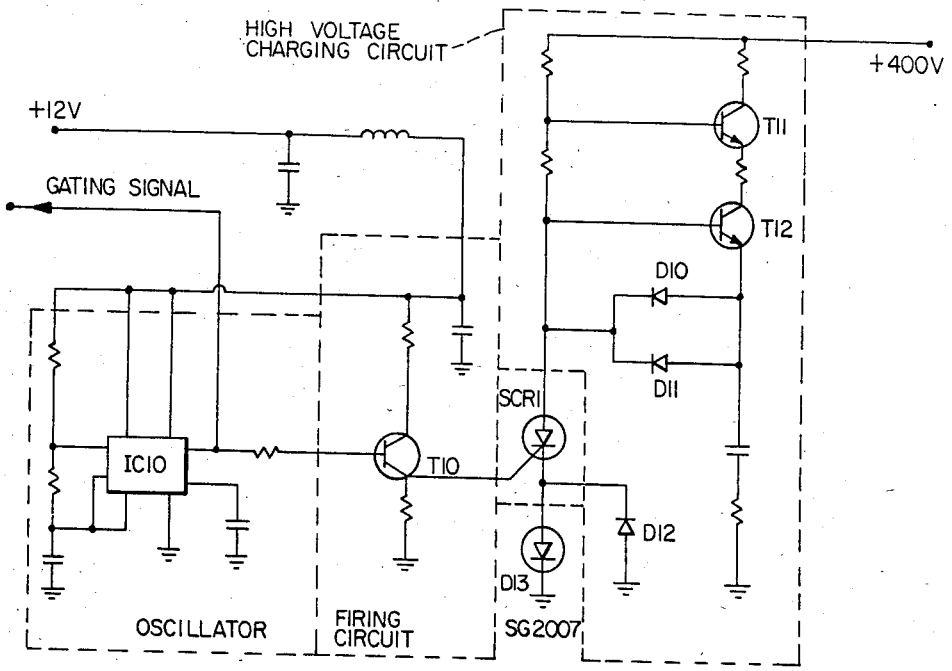
Figure 22:
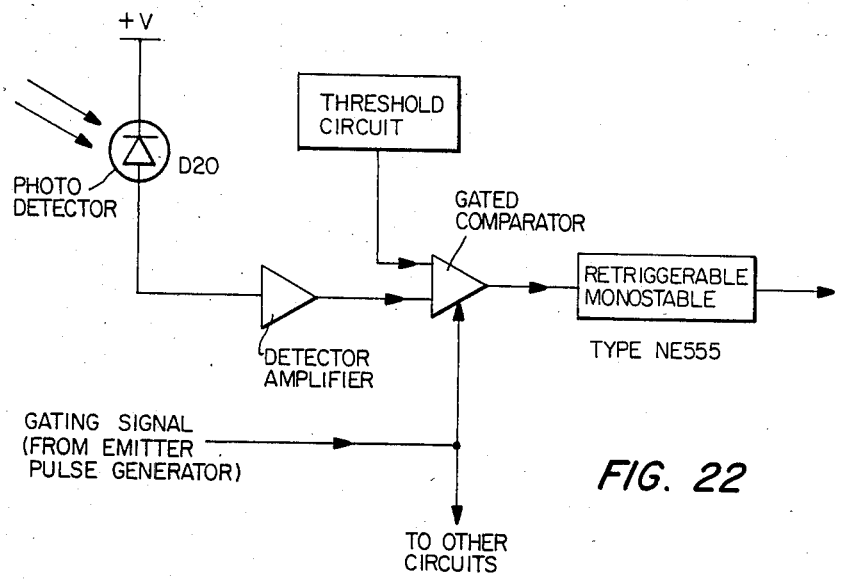
Figure 21:
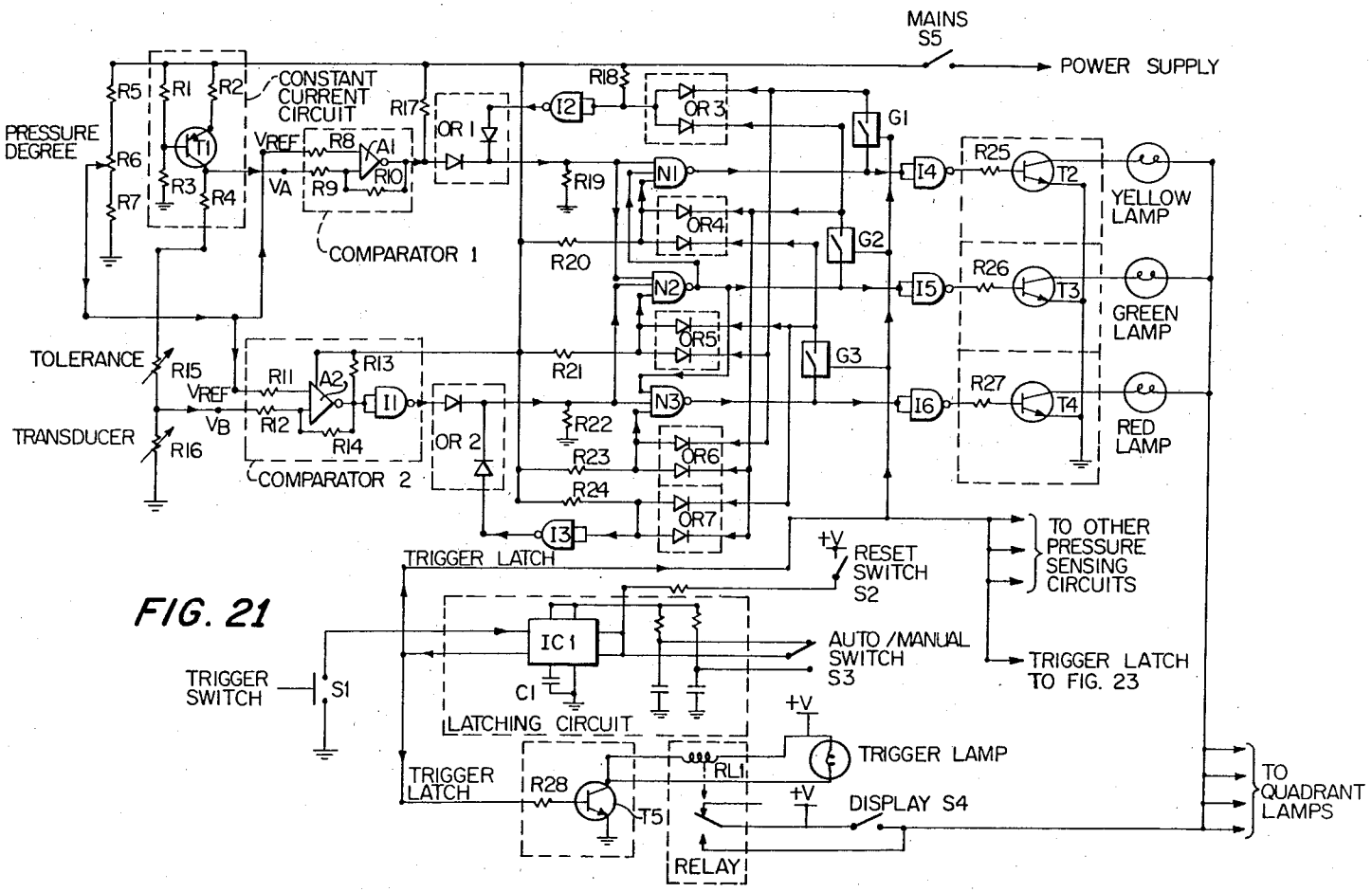
Figure 23:
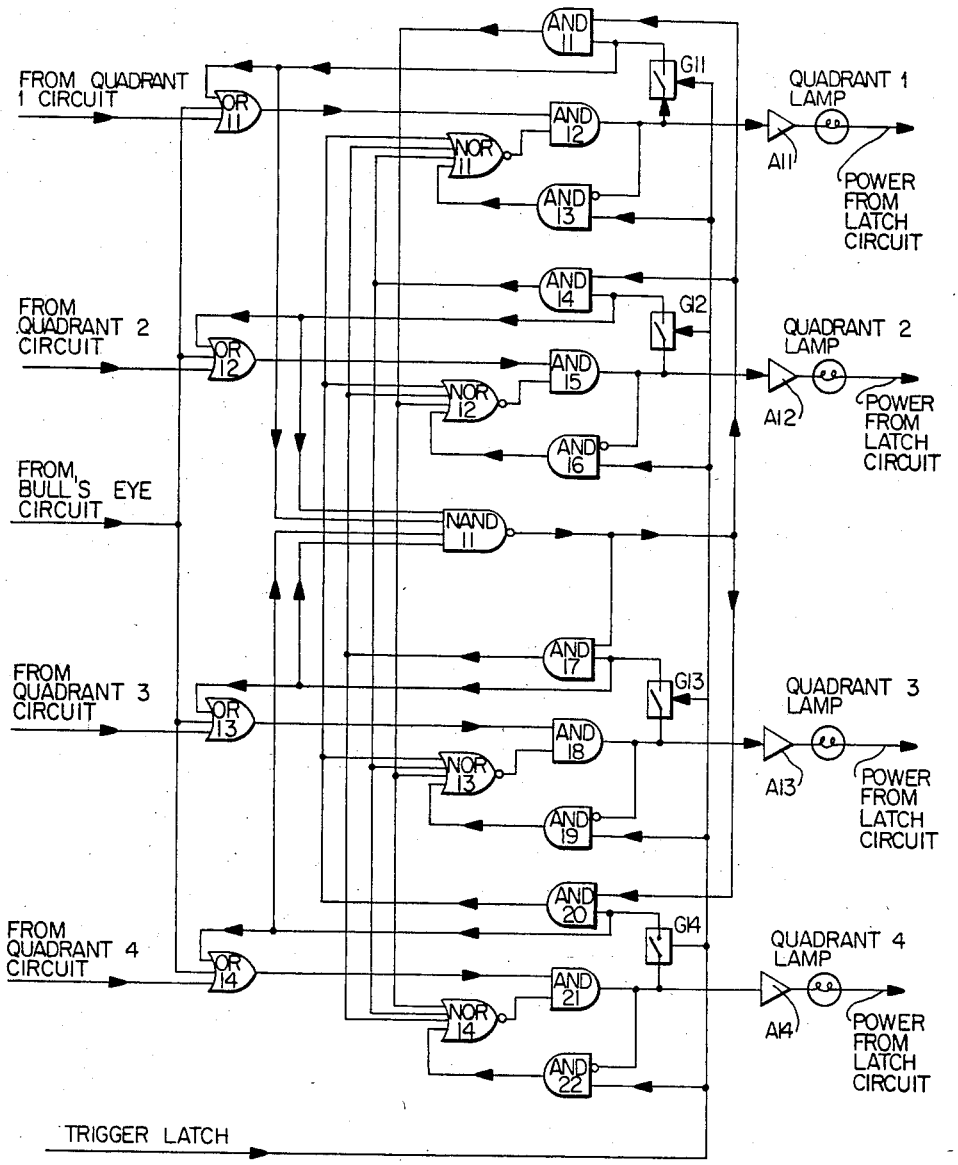
Figure 24:
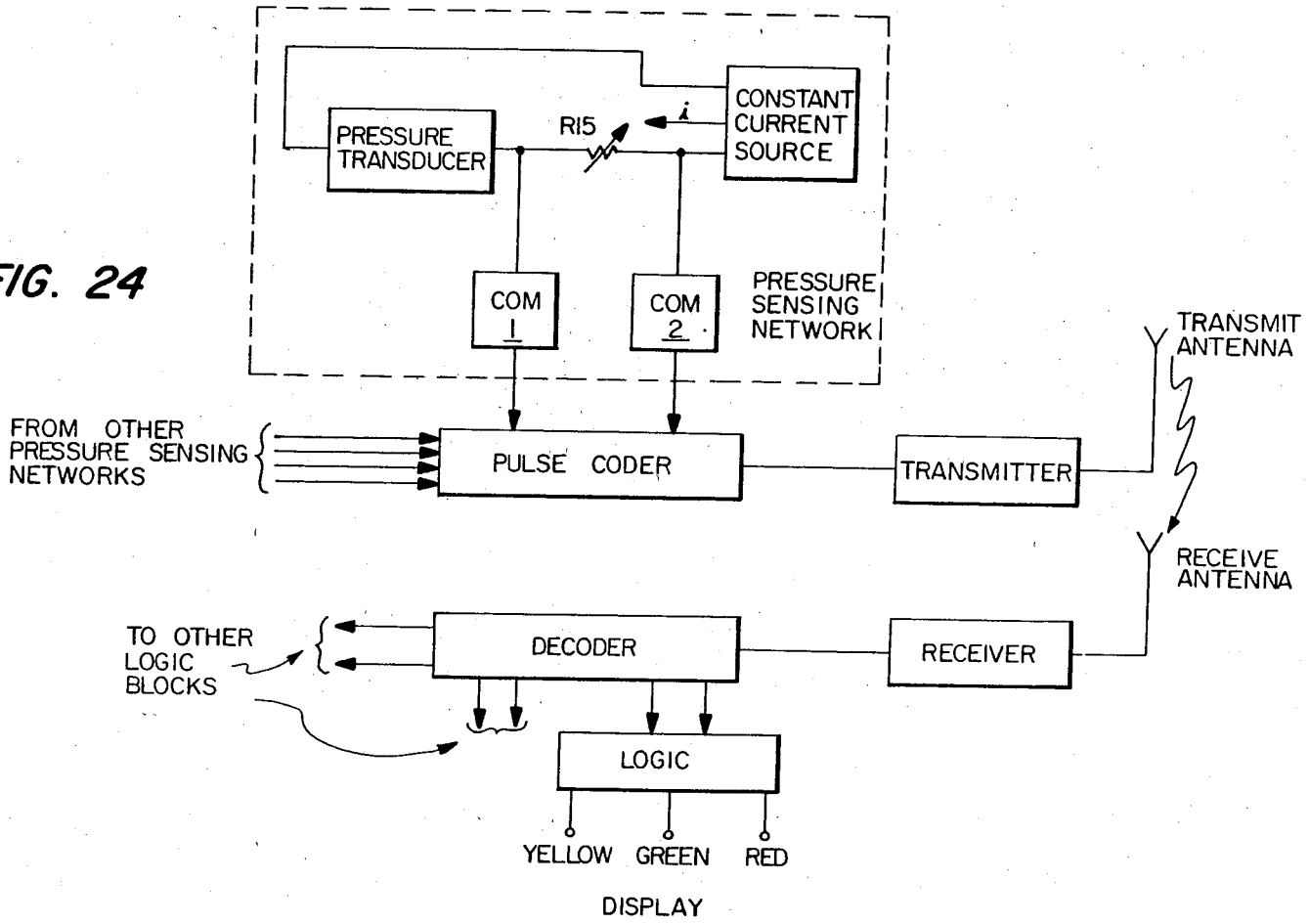

FIG, 13 is a block schematic diagram of the rifle pressure indicator circuitry;

FIG. 14 is a block schematic diagram of the accuracy of aim display circuitry;

FIG. 15 is a block schematic diagram in more detail than shown in FIG. 13 of part of the rifle pressure indicator circuitry;

FIG. 16 is a graph of certain potential levels associated with the logic and control circuitry of the pressure sensor;

FIG. 17 is a side view of a second embodiment of the invention comprising a saddle equipped for use in training correct weight distribution in horse riding;

FIG. 18 is an end view of the saddle of FIG. 17;

FIG. 19 is a front view of a display panel for use with the saddle of FIGS. 17 and 18;

FIG. 20 is a detailed circuit diagram of the accuracy of aim light transmitter circuitry of FIG. 12;

FIG. 21 is a detailed circuit diagram of the pressure sensing and latch circuitry of FIG. 13;

FIG. 22 is a block diagram of a light detector circuit for the accuracy of aim display circuitry;

FIG. 23 is detailed circuit diagram of the accuracy of aim display logic circuitry of FIG. 14; and FIG. 24 is a diagram of a pressure sensing and display circuit arrangement for use with the saddle of FIGS. 17–19.

DETAILED DESCRIPTION OF THE PREFERRED EMBODIMENTS

Figure 1:
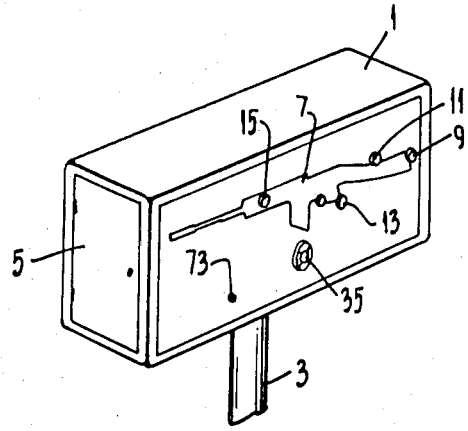
FIG. 1 is a perspective view of a display panel cabinet.
Figure 3:
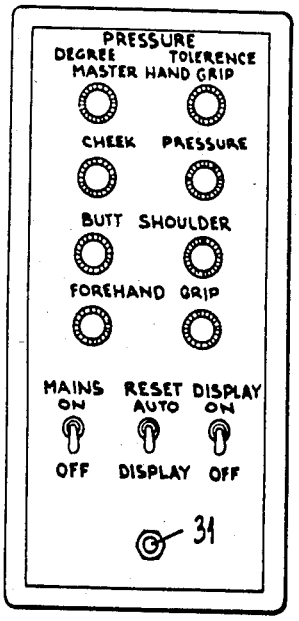
FIG. 3 is a left side view of the display panel cabinet with a control panel door removed showing the arrangement of controls for the apparatus.
Figure 2:
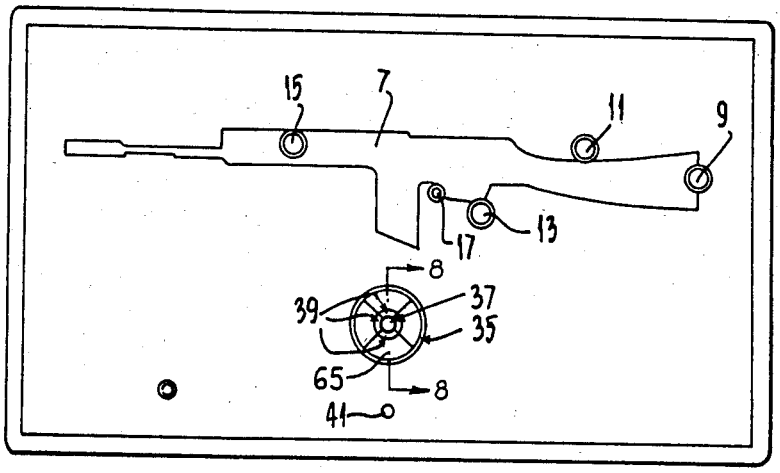
FIG. 2 is a front view of the display panel.
Figure 4:
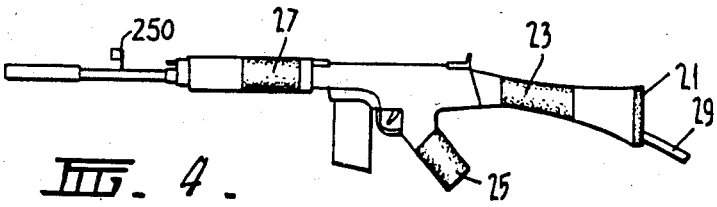
FIG. 4 is a side view of a modified rifle for use with the apparatus.

The training device is comprised of the display means, FIGS. 1, 2 and 3, and the rifle, FIG. 4. The display means has a representation of the rifle on the display with four light emitting means situated at respectively the butt of the rifle, the cheek position on the rifle, the hand grip of the rifle, and the forehand grip of the rifle. Each light emitting means can individually display a particular one of three colored lights. The three colors which each light emitting means may transmit are, for example, yellow, green and red which respectively represent too little pressure, correct pressure and too much pressure. The rifle has four pressure sensitive transducers fastened to the rifle at positions corresponding to the described positions on the representation on the display. The pressure transducers are electrically connected to the display means through a logic circuit so that on operation of the trigger of the rifle the particular colored light at each of the positions is lighted for a set time or continuously until the equipment is reset. Desirably a blank cartridge is fired on operation of the trigger to simulate firing of a real projectile. Naturally, any type of aim and pressure indicator may be used in place of or in conjunction with the colored lamps, as will be recognized by those skilled in the art.

The apparatus also includes an accuracy of aim determining means. The target of this is shown as the center of the segmented circle, under the rifle, on the display means. The target is divided into a central bull's eye with an annulus therearound divided into quadrants. Directly below the target is a pulsed infra-red (I.R.) light beam projector. The pulsed I.R. light is projected towards the rifle and directed back to the target by a reflector attached to the rifle. Each quadrant and bull's eye of the target has a photo-electric detector electrically connected for detecting the reflected I.R. light. Each quadrant photo-electric detector is connected to a visual indicator, such as a light bulb, for indicating in which quadrant the reflected I.R. light beam is received. When the bull's eye photo-electric detector is illuminated by the reflected I.R. light, all four visual quadrant indicators are activated .

On depression of the trigger of the rifle in an "automatic" mode of operation, a switch connected to the trigger is caused to generate a signal which allows for the display of both the pressure indication and the accuracy of aim indicator for a time such as 10 seconds. In a "manual" mode of operation, the indication may be manually reset. An additional indicator lamp may also be included on the display panel and positioned at the trigger of the rifle represented thereon to indicate that the trigger has been depressed and all indicator means have locked.

It should be realized that the apparatus can form a valuable part of marksmanship training because if a bull's eye or quadrant hit is not recorded and all pressure indicators show correct pressure this can only mean that the aim is incorrect. Alternatively, if a bull's eye is not recorded and certain pressure indicators show incorrect pressure, then incorrect grip of the rifle is the prime cause of poor marksmanship.

The apparatus has two pressure indicating operating states:

(1) where the pressure indicators are displayed continuously and change in accordance with the applied pressure on the rifle and lock only when the trigger is squeezed; and (2) where there is no pressure indicating display unitl the trigger has been squeezed.

The latter state is for a higher standard of training than in the former, as the trainee marksman is given no visual indication of the grip pressure until the trigger has been squeezed.

DETAILED DESCRIPTION OF THE FIRST EMBODIMENT

Referring to FIGS. 1, 2 and 3 the display means is in a cabinet 1 mounted on a height adjustable pedestal 3. The cabinet 1 has a door 5 behind which is a control panel for the apparatus. The front face of the cabinet 1 has a panel with a representation 7 of a rifle thereon and such representation has indicator means in the form of light emitting means 9, 11, 13 and 15 at positions corresponding respectively to the butt of the rifle, the cheek position on the rifle, the hand grip of the rifle, and the forehand grip of the rifle.

A further light emitting means 17 is provided for indicating that the rifle has been fired.

Each of the light emitting means 9, 11, 13 and 15 has three different colored lights mounted therein. The lights are colored yellow, green and red.

Figure 5:
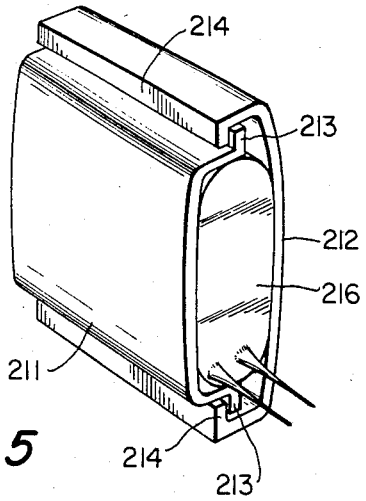
FIG. 5 is a perspective view of a pressure transducer mounted in a casing.

The rifle shown in FIG. 4 has pressure transducers 21, 23, 25 and 27 fitted at positions corresponding to those of the light emitting means 9, 11, 13 and 15. Each pressure transducer is held in a casing of two parts (see FIG. 5). Such casing has an outer part 211 of flattened top hat shape and a backing part 212 of flattened C shape so that the outside surface of the transducer assumes the contour of the rifle component in which it is mounted. The transducers are preferably secured in recesses in the demountable hand grips and stock of the rifle, attached to an otherwise conventionally constructed rifle. Alternatively, the transducers may be removably secured to the interior surface of the hand grips and stock by heat shrinkable tubing or other means, if the transducers are of sufficiently thin profile as to not interfere with operation of the rifle. As can be seen, the outward movement of the outer part 211 from the backing part 212 is limited by the flanges 213 and 214 on the respective parts but the outer part 211 can move inwardly with respect to the backing part 212.

Figure 7:
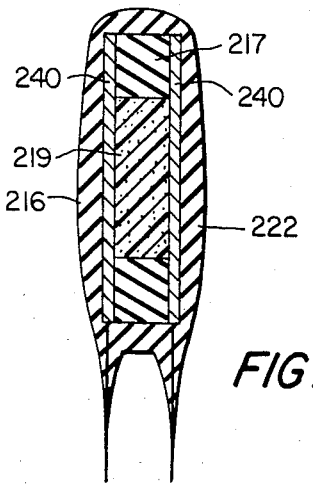
FIG. 7 is a cross-sectional view of a pressure transducer which fits into a casing.
Figure 6:
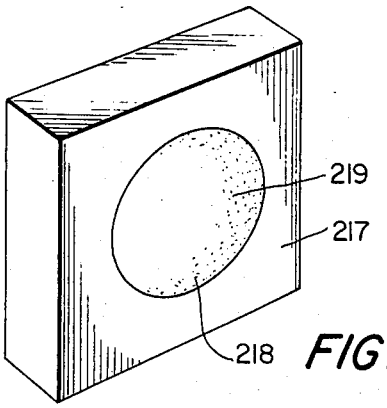
FIG. 6 is a perspective view of a portion of the inside of a pressure transducer with the outer covering and electrodes removed.

The transducer electrical portion 216 (see FIGS. 6 and 7) is mounted within the two parts 211 and 212 and the electrical leads thereof are brought out in a suitable manner. The electrical portion 216 of the transducer includes a neoprene sheet 217 of about 5 mm in thickness with a hole 218 of about 25 mm punched therein. A foam core 219 of the same dimensions is fitted in the hole 218 and two brass shim electrodes 240 of the same facial dimensions as the sheet 217 are fitted one on each side of the foam 219 and held in place by glueing at each corner to the neoprene sheet 217. The electrodes 240 have leads fastened thereto and the whole assembly is dipped into silicon rubber to give a coating 222 thereto.

The neoprene sheet 217 provides the necessary bias resiliency to the transducer while the foam core 219 serves as the electrical transducer. The silicon rubber coating is thin enough not to add greatly to the force required to cause compression of the foam core. The foam core of the transducer is a carbon impregnated polystyrene foam and is sold under the trade name Velofoam 7611 by Custom Materials Inc., of Chelmsford Mass. U. S. A. The leads of all of the transducers are electrically connected via a multi-core cable 29 (FIG. 4) from the rifle to the display circuitry by connecting in socket 31 (FIG. 3). The rifle trigger switch also electrically connects with the display circuitry by the same multi-core cable 29.

The pressure transducers change electrical resistance when subjected to pressure as the carbon particles in the foam core are compacted. A change in current flow through or voltage drop across the transducers can be related to a change in applied pressure as will be described later. Transducers 23, 25 and 27 are preferably mounted on both sides of the rifle, thus obviating the need for special rifles fitted for right and left handed trainee marksmen.

Figure 9:
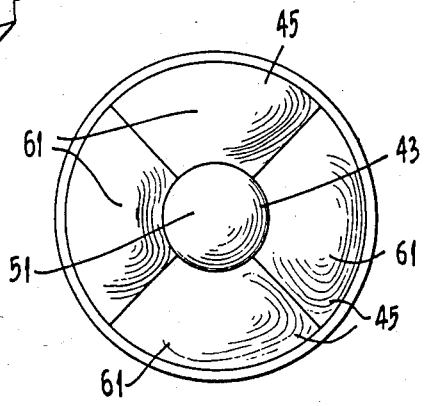
FIG. 9 is an enlarged front view of the light funnel.
Figure 10:
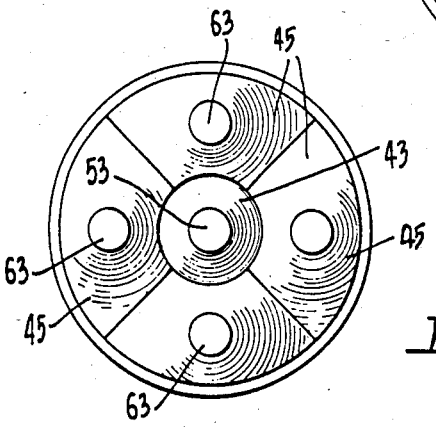
FIG. 10 is an enlarged rear view of the light funnel.

An accuracy of aim detection and indication means 35 is shown in FIGS. 1 and 2 positioned on the display panel beneath the representation of the rifle. The accuracy of aim detection and indication means 35 has a central target bull's eye section 37 with four quadrants 39 forming an annulus therearound. This can be more clearly seen in FIG. 9, which shows the front face of light funnel which constitutes the bull's eye section 37 and quadrants 39. Surrounding the quadrants 39 in an annular window 65 divided into quadrants corresponding to detector quadrants 31. Behind each quadrant of annular window 65 is an illuminating light which is operable in response to electric signals from circuitry in the display means, as will be described in more detail below.

Directly below the accuracy of aim detection and indication means 35 is a pulsed I.R. light projector 41 which is arranged with the axis of projection of the light beam directed outwardly and perpendicularly to the face of the display means. The I.R. source employs an RCA type No. SG2007 light emitter which has a divergence characteristic of about 90° in one plane and about 20° in the other plane. The source is mounted so the divergence is 90° in the horizontal plane and 20° in the vertical plane.

The block circuitry of the I.R. projector is shown in FIG. 12 and comprises an oscillator running at the pulsing frequency of the laser and an inverting switch circuit for converting the oscillator pulses into suitable signals for switching a silicon controlled rectifier S.C.R. The silicon controlled rectifier in turn switches current to the I.R. source SG 2007 at the oscillator frequency from high voltage direct current source DC2. The oscillator and inverting switch circuit are supplied with power from a separate D.C. source DCl. An output from the oscillator is used as a trigger pulse to allow the accuracy of aim detector logic (see FIG. 14) to operate only when the I.R. light is pulsed.

The light funnel is preferably made from acrylic rod and is shown in detail in FIGS. 8 to 11. It comprises a central elongate member 43 with four elongate quadrant shaped members 45 therearound. The central member 43 has a cylindrical body part 47 terminating into a truncated conical rear body part 49. The front face 51 is part of a sphere whose radius of curvature is preferably marginally greater than half the length of the member. Front face 51 defines a lens surface which concentrates incident light substantially centrally of the element in the rear body part 49 and focuses such light on a point just outside of the circular rear face 53 of the element onto the light responsive surface of a photo semi-conductor device 54 shown in FIG. 11. The diameter of the rear face 53 is substantially the same as the window face of the semi-conductor 54 used (for example, type HP 4220). The conical surface of the rear body part 49 internally reflects light which strikes that surface towards the end face 53 so that substantially all the light received at the front face 51 reaches the end face 53 and passes to the photo semi-conductor 54.

The four light members 45 are identical to one another and each has an annular segmental front body part 55 which terminates with a generally truncated conical rear end part 57 which includes a portion 59 of the surface of the radially innermost surface of the annular body part 55. The front face 61 and the end face 63 are respectively of the same curvature and diameter as the corresponding faces of the inner member 43.

Light incident on the front face of any of the members is directed to the rear face of the member and detected by the photo semi-conductor associated therewith, and used to provide an indication of the accuracy of aim at the front face of the light funnel target.

A particular alternative form of light funnel is included within the invention and such comprises using fibre optics and arranging groups of fibres sufficient to cover the desired target area and drawing the fibres down so that the end faces remote from the target face are collectively of a size so that light inciding any one is directed therethrough to the window of a photo semi-conductor and onto the photosensitive region of such device.

Figure 8:
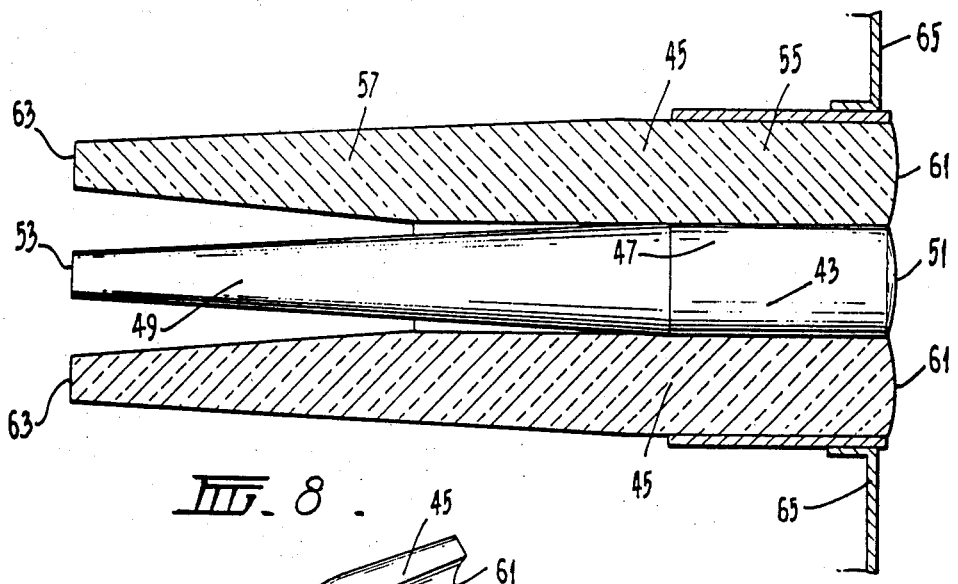
FIG. 8 is a sectional view taken along line 8—8 of FIG. 2 showing the shape of a light funnel which forms part of the apparatus for indicting the accuracy of aim of the rifle at the target area on the display panel.
Figure 11:
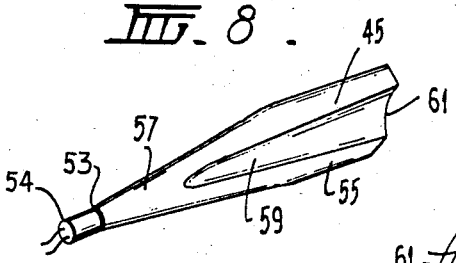
FIG. 11 is a rear perspective view of an outer segment of a light transmitting member which forms part of the funnel, with a photo semiconductor shown mounted in an operative association therewith.

FIG. 8 shows the transparent window 65 of annular shape surrounding the light funnel. This is also shown in FIG. 2 as constituted by the four quandrants surrounding quadrants 39. The quadrants of window 65 have the same angular orientation as the light member quandrants 39 and behind each is a lamp (not shown) shielded from adjacent quadrants and positioned so that when the lamp is lighted the corresponding quadrant of window 65 will be illuminated.

Referring to FIG. 3 it can be seen that controls are provided for adjusting the transducer pressure level at which the various display panel indicators will operate and the range of pressure tolerated before the indicator changes from one color to the next. Controls for these functions are shown respectively on the right and left hand sides of the control panel. Below the controls are three manually operable switches which, from left to right: switch the apparatus on or off; place the apparatus in an automatic mode (where the grip pressure and accuracy of aim indicators are held in the display condition for a 10 second period after firing the rifle) or in a manual mode (which holds the display until manually reset); and place the apparatus in a continuous display condition or a non-display condition until firing of the weapon. A reset switch mounted on the rifle, on the display panel or on the end of a cable remote from the display cabinet is provided for manually resetting the apparatus when switched to the manual mode. An indicator lamp 31 is suitably connected to the on/off switch for indicating the position of such switch.

The block diagram shown in FIG. 13 represents the circuitry for the pressure indicator means and it can be seen that for each pressure indicator there is provided an individual logic and control circuit. It can also be seen that when the trigger of the rifle is squeezed a signal is fed to each of the logic and control units. Further description of the circuitry will be given below with reference to FIGS. 15 and 21. Each of the logic and control circuits is arranged as shown in FIG. 15 and has a source of constant current which is applied to the respective pressure transducer and a series connected variable resistor R15. A variable reference voltage source is included, the output of which is applied to a respective input of each of two comparators (Com. 1 and Com. 2). The output from each side of the variable resistor R15 is also applied to respective inputs of comparators COM 1 and COM 2. The comparator outputs are fed into a logic circuit which provides an output signal to an appropriate one of the display lamps—yellow, green or red—consequent on the potential levels across the variable resistor R15. The potential levels of the reference voltage $V_{REF}$ relative to voltages $V_A$, $V_B$ from the terminals of variable resistance R15 are shown in the graph in FIG. 16 for the case where correct pressure is applied to the transducer. Reference voltage $V_{REF}$ is set by manual adjustment of the "Degree" control on the control panel (FIG. 3), while the value of resistance R15 is set by manual adjustment of the "tolerance" control.

With the reference voltage set at a particular level representative of the correct pressure to be applied to the transducer and with the variable resistance R15 adjusted to be representative of a desired tolerance range over which pressure applied to the transducer is acceptable, any change in pressure on the transducer will alter the voltage drop thereacross. Since the current is constant, the voltage drop across variable resistance R15 is constant for a given value of R15. Thus, the potential $V_A$, $V_B$ on either side of variable resistance R15 will move higher or lower in tandem, with the potential difference between $V_A$ and $V_B$ remaining constant. The comparators provide signals to the logic circuit, which is arranged to change the display from green to yellow or red when the higher or lower potentials $V_A$, $V_B$ across the variable resistance R15 cross the reference potential $V_{REF}$.

With no pressure applied to the pressure sensors voltages $V_A$ and $V_B$ will be greater than $V_{REF}$ and the yellow lamp will be operating, indicating insufficient applied pressure. When the applied pressure is increased beyond a certain amount voltage $V_B$ will decrease below that of the reference voltage $V_{REF}$ and the green lamp will then be operating. When the applied pressure increases beyond a further certain amount voltage $V_A$ will decrease below that of the reference voltage and the red lamp will be operating. A switch mounted behind the trigger of the rifle is arranged to operate a latch in the logic circuit to display and hold the particular pressure indicating lamp upon firing of the rifle as discussed above. Details of the logic circuit will be given below with reference to FIG. 21.

FIG. 14 shows a block diagram of the accuracy of aim detection and indicating apparatus. Each portion of the target light funnel has a corresponding one of photo semi-conductors D1–D5 associated therewith and mounted as in FIG. 11. Each of the elements D1–D5 is connected to a logic circuit arranged such that if a bull's eye aim is sensed all four of display lamps 1–4 are lighted and if only one of the four quadrant elements is aimed at the particular display lamp for that element is illuminated.

A mirror 250 (see FIG. 4) which is attached to the barrel of the rifle for reflecting light from the I.R. source to the light funnel is a plane mirror and has a diameter of, for example, approximately half the diameter of the central element 43 of the light funnel so that the reflected light beam size received at the light funnel is less than or equal to the diameter of the element 43. the I.R. source is sufficiently small that it may be considered a point source and, as noted above, this source emits radiation over an angle of about 90° in the horizontal plane and 20° in the vertical plane. If the rifle-mounted mirror were very large, a beam of reflected I.R. light would impinge the light funnel target as long as the mirror was within the emitted radiation angle, since there would always be a perpendicular to the mirror bisecting the angle between the I.R. source and the target. In the present invention, however, the mirror is restricted in size to one half the diameter of the bull's eye aperture, so that only when the angle between the I.R. source and the target is bisected by perpendicular to the mirror will a beam of light strike the face of the target. Thus, the mirror must be within the emitted cone of I.R. radiation nd positioned accurately with respect to the target in order to assure a "hit" on the target. The position of the trainee is therefore not extremely critical, and has no effect on the accuracy of aim detection so long as the above conditions are satisfied.

The mirror is mounted to be generally perpendicular to the barrel axis, for example by means of a lockable gymbal mount which may be released for precise adjustment of the mirror. Suitable mounting means for the mirror are known in the art and no further discussion thereof is believed necessary herein. In order to initially zero (align) a rifle with the bull's eye of the apparatus a switch S4 (described below with reference to FIG. 21) may be provided which renders the accuracy of aim circuit operative to display variations in the accuracy of the aim of the rifle as its alignment changes. Zeroing is achieved by securing the rifle in a clamp at user height and bore sighting the barrel with the bull's eye. Once the barrel is zeroed the clamp is locked rigidly in position. The mirror mount lock is released and mirror 250 is then angularly moved until the laser beam reflects onto the center of the target. This is indicated on the display panel by illumination of all four quadrant lamps behind annular window 65. The mirror 250 is then locked in this adjusted position. The size of the reflected laser beam impinging the target is typically a narrow beam of about 5 mm. diameter.

The sights of the rifle are then adjusted so that they align with the bull's eye. The rifle is thereby zeroed for bull's eye, on the target, for particular distance from the target. The clamp can then be removed and the rifle held and aimed in the normal manner from then on, although different distances from the target may require re-alignment of the mirror. It should be noted that movement of the rifle in an arc about the target within the horizontal and vertical angles of divergence of the I.R. source will not require re-alignment, as the previous alignment has aligned the rifle for a predetermined distance from the source and target.

Instead of the mirror 250 being mounted onto the barrel in a mounting means so that the angle of the plane of the mirror 250 can be adjusted, it can alternatively be mounted directly in the bore of the barrel perpendicular to the longitudinal axis thereof. Further, the mirror may be mounted in a srew-on attachment on the end of the barrel so as to locate the mirror axially of the bore, or in a blank firing attachment so as to be located centrally of the longitudinal axis of the bore, with the plane of the mirror perpendicular to the longitudinal axis of the bore.

It will be appreciated that the principles of the invention as outlined in the above preferred embodiment can be adopted for training in other fields such as horse riding, and like fields where weight or pressure of grip are critical, and the invention is intended to extend to training apparatus for such fields.

For example, in horse riding, as shown in FIGS. 17 to 19, a saddle 80 has pressure transducers 83 located at regions where weight distribution or leg pressure is critical. A display panel 85 has representations 87 of the saddle thereon, the indicator means 89 being arranged to show insufficient weight (or pressure), correct weight, or too much weight. The circuitry for this is substantially indentical to the pressure indicator circuitry in the previous embodiment, except that a suitable pulse coded radio control link between the sensors and the display circuitry panel is provided as in FIG. 24 to obviate the problem of tailing cables between the saddle and the display unit. As an alternative to this the display means may be carried by the horse.

FIG. 20 shows in greater detail than FIG. 21 the I.R. source generator circuitry. The I.R. source comprises an oscillator which may in turn comprise an integrated circuit type NE555 connected to provide an output frequency suitable for driving the I.R. light emitting element D13, RCA type SG2007, for example. Connected between the oscillator and element D13 is a firing circuit which inverts the signal from the oscillator and provides pulses for switching SCR1 to the conducting state. Direct current pulses from the high voltage charging circuit are thus supplied to D13 through SCR1 to cause emission of the I.R. radiation from D13.

FIG. 21 shows in greater detail the pressure sensing and latch circuits for the training devices. The pressure sensing circuit comprises a constant current source which includes a transistor T1 and resistors R1–R4. Resistors R1 and R3 act as bias resistors for the transistor, while resistors R2 and R4, in conjunction with transistor T1, act as a portion of a voltage divider. The voltage divider is completed by resistors R15 and R16, as will be described in more detail below.

A further voltage divider comprising resistors R5–R7 is connected between the power supply and earth. Resistors R5 and R7 are constant-value, while resistor R6 is manually adjustable so that a reference voltage may be selected from the center tap for application to respective inputs of comparators 1 and 2. The reference voltage $V_{REF}$ from the center tap of resistor R6 determines the degree of pressure on the transducer which will cause the comparators to change logic output state. This will become more apparent from further analysis of the circuit.

A pair of comparators is provided, comparator 1 comprising an inverting amplifier A1 and resistors R8–R10. Comparator 2 comprises an inverting amplifier A2, resistors R11–R14 and a logic invertor I1. The pressure tolerance range may be set by manually adjustable resistor R15, while variable resistor R16 comprises the transducer at one of the pressure points on the rifle or like weapon. Resistors R15 and R16 are series-connected with resistor R4 of the constant current circuit to form a voltage divider having output voltages $V_A$ and $V_B$. Since the current through R15 is constant, the voltage drop across R15 also remains constant for a given setting of R15. Therefore, the difference between voltage $V_A$ supplied to input resistor R9 of comparator 1 and voltage $V_B$ supplied to input resistor R12 of comparator 2 is dependent on the value of R15 and is constant for a constant value of R15. Varying the resistance of R16 by changing the pressure on the transducer therefore causes $V_A$ and $V_B$ to increase or decrease in value tandemly.

Comparator 1 provides a logic level output which is dependent on whether $V_A$ is greater or less than $V_{REF}$. Similarly, comparator 2 provides a logic output which is dependent of whether $V_B$ is greater or less than $V_{REF}$. A logic circuit for triggering a visual indication dependent on the logic output states of comparators 1 and 2 is connected to the outputs of the comparators and comprises inverters I1–I6, OR gates OR1–OR7, NAND gates N1–N3, electronic controllable switches G1–G3, and biasing resistors R17–R24. Following the logic circuitry is a series of lamp drive amplifiers comprising transistors T2–T4, having input resistors R25–R27, respectively. Each of the lamp drive amplifiers serves to switch on a respective one of the yellow, green and red indicator lamps shown at the right portion of the figure, when the appropriate logic signal is provided to the respective amplifier.

The latching circuit is shown at the lower portion of FIG. 21, and comprises an integrated circuit IC1, which may be of type NE555. The latching circuit is connected to a switch S1 which is mounted on the rifle and activated by the trigger. Also connected to the latching circuit are reset switch S2 and auto/manual switch S3. The output of the latching circuit is normally at a LO logic state (for example, 0 volts DC), and switches to a HI logic state (for example, +1 volt DC) when the trigger switch S1 is depressed. With the auto/manual switch in manual position, the logic output state of the latching circuit will remain HI for several minutes or until reset switch S2 is momentarily closed. With switch S3 in the automatic position, however, the latching circuit output will remain in the HI logic state only for a predetermined period of time, such as 10 seconds, and will revert to the LO logic state automatically at the termination of the predetermined time or when the reset switch S2 is closed. The length of time required for the latching circuit to automatically return to the LO logic state is dependent on the time constant of the circuit, which is considerably larger for the manual than the automatic mode of operation. Those skilled in the art will recognize that the time constants may be any suitable values for convenience of operation. The time limit imposed on the display in manual mode is not necessary but is desirable in the case of a battery-powered trainer to extend battery life.

Also connected to the trigger latch source is an amplifier comprising a base resistor R28 and a transistor T5. When the trigger latch pulse is at a HI logic state, transistor T5 is switched on, causing the coil of relay RL1 to be energized and causing the trigger lamp to be lighted. The trigger lamp provides a visual indication that the rifle trigger has been depressed. Upon energization of relay coil RL1, the contacts of RL1 are switched to the opposite position from that shown in FIG. 21. In this manner, the positive voltage supply +V is connected to respective terminals of the quadrant lamps shown in FIG. 23 and also to the yellow, green, and red lamps of FIG. 21. If it is desired to have continuous accuracy of aim and pressure indicator lamp display, the display switch S4 may be closed, in which case the voltage supply +V is connected to the lamps regardless of the relay position. It has been found advantageous for the trainee to begin practice with switch S4 closed so that continuous lamp display will result. After a period of training, however, switch S4 may be opened so that the indicator lamps will operate only when the trigger is depressed, thereby providing a more advanced level of training.

Turning now to the operation of the pressure sensing and latch circuits, the logic states of FIG. 21 will first be described with trigger switch S1 open and with no pressure applied to the transducer. In this circumstance, the trigger latch signal to switches G1–G3 is at a LO logic state and the switches are therefore in the open position. Switches G1–G3 are connected such that their respective outputs are in the HI logic state when the gates are open. Thus, all the inputs to OR gates OR-3–OR7 are in the HI logic state and the outputs of gates OR3–OR7 are also in the HI logic state. It is to be noted that gates OR3–OR7 are connected such that a LO logic level output is obtained if either input is LO, while gates OR1, OR2 are connected such that a HI logic output is obtained if either output is HI. With no pressure applied to the transducer outputs of both comparator amplifiers A1 and A2 are HI, and the output of inverter I1 is LO. It can thus be seen that NAND gate N1 is the only gate of N1–N3 to have all inputs HI so that the output of N1 is LO and the outputs of N2, N3 and HI. The LO output of gate N1 is inverted by I4 to switch on transistor T2, causing the yellow lamp to be illuminated.

If sufficient pressure is applied to the transducer so that voltage $V_B$ falls below $V_{REF}$, then amplifier A2 of comparator 2 changes state and the output of inverter I1 becomes HI. Because all of switches G1–G3 are open, the inputs of gates OR3–OR7 are HI and the outputs of gates OR3–OR7 are also HI. Therefore, all three inputs to NAND gate N2 are HI and output of NAND gate N2 is LO. The output of NAND gate N2 disables gates N1 and N3, making their outputs HI. The LO output of gate N2 is supplied to inverter I5 and the resulting HI logic level output switches on transistor T3, causing the green lamp to be illuminated.

When sufficient additional pressure is applied to the transducer so that both voltages $V_A$ and $V_B$ fall below $V_{REF}$, comparator 1 changes to the LO logic output state. The output of inverter I1 is still HI, as are the outputs of OR3–OR7 due to switches G1–G3 being open. Therefore, all three inputs to NAND gate N3 are HI. The output of NAND gate N3 is inverted by I6, causing the red lamp to be illuminated.

Taking the case when yellow lamp is illuminated, squeezing the trigger will cause the trigger latch signal to change to the HI logic state, closing switches G1–G3. The yellow lamp is still illuminated, the output of NAND N1 is still LO and the outputs of NAND gates N2 and N3 are still HI. Upon closing of switches G1–G3 the outputs of OR3, OR5 and OR6 become LO and I2 inverts the output of OR3 so the output of OR1 remains HI. The LO outputs of OR5 and OR6 disable NAND GATES N2 and N3, causing the outputs of N2 and N3 to remain HI. The outputs of OR4 and OR7 remain HI. Therefore, gate N1 is the only NAND with all inputs HI, and this is true regardless of the outputs of comparator amplifiers A1 and A2. It can thus be seen that squeezing of the trigger with the yellow lamp illuminated will cause the yellow lamp to remain illuminated until the latching circuit of FIG. 21 is reset.

When the green lamp is illuminated and the trigger is squeezed, the trigger latch signal goes to the HI logic state and causes switches G1–G3 to close. The output of NAND gate N2 is LO and the outputs of NAND gates N1 and N3 are HI, so that closing of switches G1–G3 causes the outputs of OR3, OR4, OR6 and OR7 to change from HI to LO. The outputs of OR3 and OR7 are inverted by I2 and I3, respectively, ensuring that the outputs of OR1 and OR2 are HI. The LO outputs of OR4 and OR6 serve to disable NAND gates N1 and N3, ensuring that the outputs of N1 and N3 remain HI. The output of OR5 remains HI so that gate N2 is the only NAND gate with all inputs HI, regardless of the outputs of comparator amplifiers A1 and A2. Thus, squeezing the trigger when the green lamp is illuminated serves to hold the green lamp on until the latching circuit of FIG. 21 is reset. Operation of the logic circuit of FIG. 21 for the red lamp is similar to that for the yellow lamp and therefore will not be described herein in detail.

At the lower right hand portion of FIG. 21, it can be seen that the trigger latch signal is supplied to further pressure sensing circuits. A pressure sensing circuit of the type shown in FIG. 21 is provided for each of the transducers which is to be mounted on the rifle or like weapon. Operation of the further pressure sensing circuits is the same as that shown in FIG. 21, and therefore no further discussion thereof is believed necessary. The power source to the red, green and yellow lamps which is connectable through either the contacts of relay R1 or of display switch S4 is also provided to the quadrant lamps, as will be described with reference to FIG. 23, and provides power for lighting such quadrant lamps. The trigger latch signal provided to the pressure sensing circuits from the latching circuit is also provided to the quadrant lamp circuit shown in FIG. 23.

FIGS. 22 and 23 show in greater detail the accuracy of aim detector circuitry of FIG. 14. FIG. 22 shows a detector circuit which receives the I.R. light reflected from the rifle-mounted mirror and generates a logic signal representative thereof. A circuit as shown in FIG. 22 is provided for each of the four quadrants of the target, and such a circuit is also provided for the bull's eye of the target. For simplicity, only one such circuit is shown.

In FIG. 22, a photodetector is shown which receives the I.R. light reflected from the rifle-mounted mirror and funneled through a respective one of the acrylic rods forming the light funnel. Upon receipt of the reflective light, the photodetector D20 begins to conduct and provides a signal to a detector amplifier, which amplifies the signal from D20 and provides the amplified signal to one input of a comparator. A threshold circuit provides a reference threshold voltage to a second input of the comparator. The gating signal received from the emitter pulse generator of FIG. 20 enables the comparator and permits the comparator to provide a signal to a re-triggerable monostable element, which gives a HI or LO logic output depending upon the conductive state of the photodetector D20. The gating signal is supplied to each of the five comparators which correspond to the five segments of the target. The re-triggerable monostable element may be constructed in a manner known in the art, for example using an integrated circuit type NE555.

The logic output of the re-triggerable monostable element of each of the five circuits as shown in FIG. 22 is provided to a respective input at the left portion of FIG. 23, which comprises the logic circuitry for lighting the quadrant lamps in response to a "hit" of reflected I.R. light onto the target area. The logic circuit of FIG. 23 comprises OR gates OR11–OR14, NOR gates NOR11–NOR14, AND gates AND11–AND22, NAND gate 11, switches G11–G14 and amplifiers A1-1–A14. Switches G11–G14 are bilateral electronic switches which, when in open circuit position, would leave the inputs of the following gates open circuited. To avoid this situation in practice, the switch contact is terminated to ground with a resistor so the respective switch output is LO when the switch is open. This contrasts with the connection of switches G1–G3 of FIG. 21. For simplicity of illustration, the termination to ground of G11–G14 is not shown in FIG. 23. Each of the amplifiers A11–A14 comprises, for example, a base resistor and a transistor such as resistor R25 and transistor T2 of FIG. 21. The amplifiers serve to switch on quadrant lamps 1–4 in response to appropriate signals from the logic circuitry.

Turning now to the operation of FIG. 23, a HI logic level appears on the input to OR11 from the quadrant 1 circuit when quadrant 1 is illuminated by reflected I.R. light. The remaining inputs to OR11 are LO since the bull's eye is not illuminated and since there is a terminating resistor to ground (not shown) on the output contact of switch G11. Therefore the output of OR11 is HI and one input of gate AND11 is HI. Since the trigger latch is LO at AND13 (the trigger not having been squeezed yet), the output of AND13 is LO. Because the output switch contacts of G11–G14 are terminated LO, the outputs of gates AND11, AND14, AND17 and AND20 are also LO. This ensures that all inputs to gate NOR11 are LO and that the output of NOR11 is HI. With both inputs of AND12 HI, the output of AND12 is HI. Amplifier A11 receives the HI output of AND11, causing the quadrant 1 lamp to be illuminated. Operation of the FIG. 23 arrangement for the conditions where quadrants 2, 3, or 4 are illuminated by reflected I.R. light is comparable to that for quadrant 1.

In the case where the bull's eye is illuminated by reflected I.R. light, a HI logic level appears on one input of each of gates OR11–OR14. The remaining two inputs of each of these OR gates are at the LO logic state since none of the individual quadrants is illuminated by I.R. light and since the output contacts of switches G11–G14 are terminated LO, the trigger not having yet been squeezed. Therefore a HI logic state appears on the outputs of OR11–OR14 and on one input of each of gates AND12, AND15, AND18 and AND21. Because the output contacts of switches G11–G14 are terminated LO, the outputs of gates AND11, AND14, AND17 and AND20 are also LO. This ensures that all inputs to gates NOR11, NOR12, NOR13 and NOR14 are LO and that the output of last of these four gates is LO. The outputs of gates AND12, AND15, AND18 and AND21 are therefore HI, causing all of the quadrant lamps to be illuminated through amplifiers A11–A14.

Consider now the action of the circuit of FIG. 23 when a single quadrant is illuminated by I.R. light and the trigger is squeezed, causing the trigger latch signal to change from LO to HI to close switches G11–G14. Prior to closing of switches G11–G14 the output of AND12 is HI and the outputs of AND15, AND18 and AND21 are all LO. Closing switch G11 causes the inputs to AND11 and OR11 to change from LO to HI, while closing switches G12–G14 has no effect on the inputs of gates connected thereto. There is therefore no change in the HI output of NAND11 since only one of its inuts is HI. Both inputs to AND11 now being HI, the output of AND11 becomes HI, causing the outputs of NOR12, NOR13 and NOR14 to become LO. Gates AND15, AND18 and AND21 are in turn disabled so that their respective outputs are held in the LO logic state, resulting in quadrant lamps 2, 3 and 4 being held off. Because switch G11 supplies a HI logic state to one input of gate OR11, the output of OR11 is HI regardless of the other inputs. Thus, signals from the detector circuits have no effect on the logic of FIG. 23 once quadrant lamp 1 is latched on by squeezing the trigger, until the trigger latch signal is reset to the LO logic state. Operation for the conditions where quadrants 2, 3 or 4 are illuminated by I.R. light when the trigger is squeezed is similar to that for quadrant 1 and will not be described in detail herein.

Taking the case where the bull's eye is illuminated by I.R. light when the trigger is squeezed, it will be seen that all four quadrant lamps are latched on until the trigger latch signal is reset. Prior to closing of switches G11–G14 the outputs of AND12, AND15, AND18 and AND21 are all HI. Closing of switches G11–G14 in response to the HI trigger latch signal causes inputs to gates AND11, AND14, AND17, AND20 and OR1-1–OR14 to change from LO to HI. This ensures that the outputs of OR11–OR14 are always HI and that all inputs to NAND11 are HI, making the output of NAND11 become LO. The outputs of gates AND11, AND14, AND17 and AND20 therefore become LO. Since all inputs to NOR11–NOR14 are LO, their respective outputs are HI, sending the outputs of AND12, AND15, AND18 and AND21 HI. All four quadrant lamps are thereby latched on until the trigger latch signal is reset from HI to LO.

FIG. 24 shows a block diagram of a modification of the circuitry of the rifle training system which could be used, for example, with the horse riding training saddle of FIGS. 17–19. For each pressure transducer on the saddle or other training device, a pressure sensing network of the type shown in FIGS. 15 and 21 is provided. Between the pressure sensing network and the logic circuitry which provides signals to the yellow, green, and red display lamps is an arrangement which avoids the necessity of a cable connection between the training device and the display panel. As shown in FIG. 24, the pressure sensing network outputs from comparators 1 and 2 are provided to a pulse coder which drives a transmitter. The pressure sensing networks, pulse coder and transmitter may be mounted on the saddle and may be battery operated. The display panel has a receiving antenna and receiver with decoder for providing the signals corresponding to the outputs of comparators 1 and 2 to a logic circuit with display lamps for each of the pressure sensing networks. Since any suitable coder/decoder and transmitter/receiver apparatus known in the art could be used for this purpose, details of such elements are not included herein.

Those skilled in the art will recognize that numerous modifications may be made within the spirit and scope of the abovedescribed invention. For example, the pressure sending transducers for training in the proper holding of the rifle may be attached to a garment such as a field jacket, vest or gloves worn by the trainee, rather than having the transducers mounted on the rifle itself. Those skilled in the art will also recognize that the training apparatus of the present invention is equally applicable to handguns or to other firearms. It is accordingly intended that the scope of the invention not be limited by the above description, but be defined by the following claims.

We claim:

1. Apparatus for training in the use of a firearm, comprising:

a training firearm;

at least one transducer means positioned relative to the firearm and coupled for providing a signal representing pressure applied to the training firearm;

a circuit means responsive to said transducer signal for defining a transducer signal range corresponding to a predetermined optimal range of pressure applied to the firearm; and an indicator means responsive to said circuit means for providing an indication when the pressure applied to the firearm at said transducer means is within said predetermined optimal range.

2. The apparatus of claim 1 wherein said transducer means is detachably mounted on said firearm.

3. The apparatus of claim 1 wherein the firearm includes a recess for receiving said transducer means, said transducer means being mounted in said recess.

4. The apparatus of claim 1 wherein said transducer means comprises a pair of terminals and means for varying the electrical resistance between said terminals in dependence on applied pressure.

5. The apparatus of claim 4 wherein said resistance-varying means comprises a resiliently deformable, carbon-impregnated core.

6. The apparatus of claim 1 wherein said circuit means comprises means for determining whether said transducer signal corresponds to a pressure applied to the firearm which is within, less than or greater than said predetermined optimal range, and said indicator means comprises means operatively connected to the determining means for providing a first indication when the pressure applied to said transducer means is within said predetermined optimal range, a second indication when the pressure applied to said transducer means is less than said predetermined range, and a third indication when the pressure application to said transducer means is greater than said predetermined range.

7. The apparatus of claim 1 wherein said indicator means comprises a representation of said firearm having means for indicating when the pressure applied to the firearm is within said predetermined range, each of said indicating means being responsive to a signal from an associated transducer means, and each of said indicating means being located on said representation at a position corresponding to the position of the associated transducer means relative to said firearm.

8. The apparatus of claim 1 wherein said circuit means comprises:

means for defining a range of variation of said transducer signal corresponding to said predetermined optimal range of applied pressure; and means for controlling said indicator means to provide said indication when said transducer signal is within said defined range of variation.

9. The apparatus of claim 1 wherein said transducer means is a variable-resistance element and said circuit means comprises:

means for producing a reference voltage;

a resistance connected in series with said transducer means;

means for supplying a constant current to said series-connected resistance and said transducer means;

first means for comparing the combined voltage drop across said transducer means and said resistance with said reference voltage and producing a first control signal having a value dependent on which of the compared voltages is greater;

second means for comparing the voltage drop across said transducer means with said reference voltage and producing a second control signal having a value dependent on which of the compared voltages is greater; and means for controlling said indicator means indication in dependence on said first and second control signals.

10. The apparatus of claim 10 wherein said indicator means provides a first indication when said first and second control signals represent the condition that the pressure applied to said transducer means is less than said predetermined range, a second indication when within said predetermined range, and a third indication when greater than said predetermined range.

11. The apparatus of claim 9 wherein said resistance is manually adjustable, whereby the magnitude of pressure variation of said predetermined range may be manually selected.

12. The apparatus of claim 9 wherein said reference voltage is manually adjustable, whereby the lower limit of said predetermined range may be manually selected.

13. The apparatus of claim 9 wherein said first and second control signals are logic signals and said controlling means comprises a logic circuit.

14. The apparatus of claim 9 wherein said display means provides a continuous indication of the pressure applied to said transducer means.

15. The apparatus of claim 9 wherein said firearm has a trigger mechanism and said indicator means indication is normally deactivated, further comprising means for activating said indicator means indication when said trigger mechanism is squeezed.

16. The apparatus of claim 15, further comprising means for manually resetting said indicator means indication to the deactivated state.

17. The apparatus of claim 15, further comprising means for automatically resetting said indicator means indication to the deactivated state at the end of a predetermined elapsed time following squeezing of said trigger.

18. The apparatus of claim 9 wherein said controlling means comprises means for latching said indicator means indication at its existing state until reset.

19. The apparatus of claim 18, wherein said firearm has a trigger mechanism and further comprising means for rendering said latching means operative in response to squeezing the trigger mechanism.

20. The apparatus of claim 18 further comprising means for manually resetting said latching means.

21. The apparatus of claim 18 wherein said circuit means further comprises means for automatically resetting said latching means at the end of a predetermined elapsed time.

22. The apparatus of claim 1 wherein said firearm has a trigger mechanism and said indicator means further comprises means for indicating when the trigger mechanism is squeezed.

23. The apparatus of claim 1, further comprising a target and means for determining accuracy of aim of said firearm with respect to said target.

24. The apparatus of claim 1 wherein said transducer means is positioned with respect to said firearm by attachment to a garment worn by the user of the firearm.

25. Apparatus for training in the accuracy of aim of a firearm, comprising:

a training firearm;

means for projecting a beam of light toward said firearm;

means mounted on said firearm for reflecting said light beam towards a target when said firearm is aimed at said target;

a target having means for receiving said reflected light beam and providing a control signal in response to the received light beam; and means responsive to said control signal for displaying an indication of the accuracy of aim of said firearm with respect to said target; and means for training in the correct holding of said firearm, comprising:

at least one transducer means positioned relative to the firearm and coupled for providing a signal representing pressure applied to the firearm;

circuit means responsive to said transducer signal for controlling a pressure display means, the circuit means defining a transducer signal range corresponding to a predetermined optimal range of pressure applied to the firearm; and pressure indcator means responsive to said circuit means for providing an indication when the pressure applied to the firearm is within said predetermined optimal range.

26. Apparatus for training a horseman as to correct pressure distribution on a saddle, comprising:

a saddle;

at least one transducer means positioned relative to the saddle and coupled for providing a signal representing pressure applied to the saddle by the horseman;

circuit means responsive to said transducer signal for controlling a display means, the circuit means defining a transducer signal range corresponding to a predetermined optimal range of pressure applied to the saddle; and indicator means responsive to said circuit means for providing an indication when the pressure applied to the saddle at said transducer means is within said predetermined optimal range.

27. The apparatus of claim 26 wherein said transducer means is detachably mounted on said saddle.

28. The apparatus of claim 26 wherein the saddle includes a recess for receiving said transducer means, said transducer means being mounted in said recess.

29. The apparatus of claim 26 wherein said transducer means comprises a pair of terminals and means for varying the electrical resistance between said terminals in dependence on applied pressure.

30. The apparatus of claim 29 wherein said resistance-varying means comprises a resiliently deformable, carbon-impregnated core.

31. The apparatus of claim 26 wherein said circuit means comprises means for determining whether said transducer signal corresponds to a pressure applied to the saddle which is within, less than, or greater than said predetermined optimal range, and said indicator means comprises means operatively connected to the determining means of the circuit means for providing a first indication when the pressure applied to said transducer means is within said predetermined optimal range, a second indication when the pressure applied to said transducer means is less than said predetermined range, and a third indication when the pressure applied to said transducer means is greater than said predetermined range.

32. The apparatus of claim 26 wherein said indicator means comprises a representation of said saddle having means for indicating when the pressure applied to the saddle is within said predetermined range, each said indicating means responsive to the signal from an associated transducer means, and each said indicating means located on said representation at a position corresponding to the position of the associated transducer means on said saddle.

33. The apparatus of claim 26 wherein said circuit means comprises:

means for defining a range of variation of said transducer signal corresponding to said predetermined optimal range of applied pressure; and means for controlling said indicator means to provide said indication when said transducer signal is within said defined range.

34. The apparatus of claim 26 wherein said transducer means is a variable-resistance element and said circuit means comprises:

means for producing a reference voltage;

a resistance connected in series with said transducer means;

means for supplying a constant current to said series-connected resistance and said transducer means;

first means for comparing the combined voltage drop across said transducer means and said resistance with said reference voltage and producing a first control signal having a value dependent on which of the compared voltages is greater;

second means for comparing the voltage drop across said transducer means with said reference voltage and producing a second control signal having a value dependent on which of the compared voltages is greater; and means for controlling said indicator means indication in dependent on said first and second control signals.

35. The apparatus of claim 34 wherein said indicator means provides a first indication when said first and second control signals represent the condition that the pressure applied to said transducer means is less than said predetermined range, a second indication when within said predetermined range, and a third indication when greater than said predetermined range.

36. The apparatus of claim 34 wherein said resistance is manually adjustable, whereby the magnitude of pressure variation of said predetermined range may be manually selected.

37. The apparatus of claim 34 wherein said reference voltage is manually adjustable, whereby the lower limit of said predetermined range may be manually selected.

38. The apparatus of claim 34 wherein said first and second control signals are logic signals and said controlling means comprises a logic circuit.

39. The apparatus of claim 34 wherein said indicator means provides a continuous indication of the pressure applied to said transducer means.

40. The apparatus of claim 26, further comprising a radio transmitter/receiver link between said transducer means and said indicator means.

41. The apparatus of claim 40 wherein said radio link comprises a transmitter having means for pulse coding the signals from a plurality of said transducer means and a receiver having means for decoding the pulse coded signals from said transmitter.

42. Apparatus for training as to the correct user interface with sporting equipment, comprising:

at least one transducer means suitable to be attached to said sporting equipment for providing a signal which varies in accordance with a force applied at an interface between a user and said sporting equipment;

circuit means responsive to said transducer means signal for controlling a display means; and indicator means responsive to said circuit means for providing an indication of said applied force as detected by said at least one transducer means, said indicator means providing a first indication for one range of forces when detected by said at least one transducer means and a second indication for another range of forces when detected by said at least one transducer means.

43. Apparatus according to claim 42, wherein each said range has an upper and a lower limit, and said circuit means comprises means for adjustably presetting said upper and lower limits of each said range.

44. Apparatus according to claim 42, wherein said indicator means comprises a visual representation of said sporting equipment, each said indicating means being positioned on said representation at a location corresponding to the position of an associated said transducer on said sporting equipment.

45. Apparatus according to claim 42, wherein said at least one transducer is detachably mounted with respect to said sporting equipment.

46. Apparatus according to claim 45, wherein said sporting equipment includes a recess for receiving at least one said transducer, said transducer mounted in said recess.

47. Apparatus according to claim 42, wherein said at least one transducer comprises a pair of terminals and means for varying the electrical resistance between said terminals in dependence on forces of pressure or weight applied to said interface.

48. Apparatus according to claim 47, wherein said resistance varying means comprises a resiliently deformable, carbon-impregnated core.

49. Apparatus according to claim 42, wherein said transducer means comprises a variable-resistance element and said circuit means comprises:

means for producing a reference voltage;

a resistance connected in series with said transducer means;

means for supplying a constant current to said series-connected resistance and said transducer means;

first means for comparing the combined voltage drop across said transducer means and said resistance with said reference voltage and producing a first control signal having a value dependent on which of the compared voltages is greater;

second means for comparing the voltage drop across said transducer means with said reference voltage and producing a second control signal having a value dependent on which of the composed voltages is greater, and means for controlling said indicator means indication in dependent on said first and second control signals.

50. Apparatus according to claim 49, wherein said resistance is manually adjustable, whereby a range of said applied force as detected by said transducer means for which a said indication is provided may be manually selected.

51. Apparatus according to claim 50, wherein said reference voltage is manually adjustable, whereby a lower limit of said range of applied force may be manually selected.

* * * * *